United States Patent [19]

Castonguay et al.

[11] 4,128,750

[45] Dec. 5, 1978

[54] CIRCUIT BREAKER CLOSURE CONTROL AND CONDITION INDICATOR APPARATUS

[75] Inventors: Roger N. Castonguay, Terryville; Charles L. Jencks, Avon; Robert C. Turton, Plainville, all of Conn.

[73] Assignee: General Electric Company, New York, N.Y.

[21] Appl. No.: 881,269

[22] Filed: Feb. 27, 1978

[51] Int. Cl.[2] ..... H01H 9/00; H01H 3/00

[52] U.S. Cl. ..... 200/308; 200/153 SC; 200/154; 200/321

[58] Field of Search ..... 200/308, 78, 153 SC, 200/154, 239, 290, 321, 322

[56] References Cited

U.S. PATENT DOCUMENTS

| | | | |
|---|---|---|---|
| 2,222,312 | 11/1940 | Green | 200/308 X |
| 2,854,555 | 9/1958 | Edmonds | 200/308 |
| 2,925,481 | 2/1960 | Casey | 200/308 X |

*Primary Examiner*—Stephen P. Garbe
*Assistant Examiner*—STeven M. Pollard
*Attorney, Agent, or Firm*—Robert A. Cahill; Walter C. Bernkopf; Philip L. Schlamp

[57] ABSTRACT

A circuit breaker is provided with a hook operating to hold the breaker movable contacts open against the bias of charged mechanism springs. The hook is selectively actuated to release the contacts for abrupt closure under the urgence of the mechanism springs. An indicator is appropriately positioned under the joint control of the breaker mechanism and movable contacts to display the existing breaker condition.

10 Claims, 5 Drawing Figures

CIRCUIT BREAKER CLOSURE CONTROL AND CONDITION INDICATOR APPARATUS

BACKGROUND AND OBJECTS OF THE INVENTION

In certain applications it is necessary to coordinate or synchronize the closure of a circuit breaker with the functioning of other electrical apparatus, such as generators. With the typical industrial circuit breaker, charging of its mechanism springs preparatory to closure of its contacts is achieved by articulation of a manual operating handle. Normally, it is impossible to predict with any degree of precision when, after the mechanism springs have become fully charged, the mechanism has reached the condition where the springs can discharge pursuant to powering the breaker movable contacts to their closed circuit positions in engaging relation with the breaker stationary contacts. For the traditional toggle-type breaker operating mechanism, this condition is reached when, during mechanism articulation, the line of action of the mechanism springs moves from one side to the other side of a particular toggle pivot point.

To provide rather precise control of the moment of closure of breaker contacts, a hook has been used to hold the breaker movable contacts in their open positions against the bias of the mechanism springs, despite the fact that the breaker mechanism has been articulated to its contact closure condition. When contact closure is desired, the hook is simply articulated to release the breaker movable contacts which then abruptly spring to their closed positions under the urgence of the mechanism springs. It is seen that in this arrangement, the circuit breaker has three stable conditions, that is, the circuit breaker may be not only open or closed, but also charged and ready to be closed. Since the breaker operating handle typically cannot distinctively indicate by its position each of these three breaker conditions, it is highly desirable to provide a separate indicator mechanism operable to unambiguously identify whether the breaker is open, closed or charged and ready to close. Commonly assigned, U.S. Pat. No. 4,042,896 discloses the utilization of a hook to hold breaker movable contacts open while the breaker mechanism is charged and indicator apparatus to identify these various conditions assumed by the circuit breaker.

It is a principal object of the present invention to provide simplified and cost-improved apparatus for controlling the closure of circuit breaker contacts and for indicating the circuit breaker condition.

A further object of the present invention is to provide circuit breaker contact closure control and condition indicator apparatus of the above character which is inexpensive to manufacture, compact, and reliable in operation.

Other objects of the invention will in part be obvious and in part appear hereinafter.

SUMMARY OF THE INVENTION

In accordance with the present invention, there is provided apparatus for controlling the closure of circuit breaker contacts and for indicating the existing circuit breaker condition. More specifically, the apparatus of the present invention includes latching means for releaseably retaining the breaker movable contacts in their open circuit position, despite the fact that the breaker operating mechanism has been articulated to a condition calling for closure of the breaker contacts.

That is, the mechanism springs have been charged, and the operating mechanism is in the condition where the mechanism springs would propel the movable contacts into engagement with the breaker stationary contacts, but for the restrain imposed on the movable contacts by the latching means. At the instant breaker closure is desired the latching means is actuated, either manually or electromechanically, to release the movable contacts, and the mechanism springs discharge to close the breaker.

To indicate the existing condition of the circuit breaker, the apparatus of the present invention further includes a pivotally mounted indicator arm carrying at one end a display panel bearing various breaker condition indicia. The other end of the indicator arm is coupled with the breaker movable contacts so as to sense whether they are open or closed. Also acting on the indicator arm is an actuator element coupled with the breaker operating mechanism to sense whether the mechanism springs are charged or discharged.

When the breaker contacts are open and the breaker mechanism is in its open circuit condition, i.e., the mechanism springs discharged, the indicator arm is angularly positioned by a return spring such as to register in a window provided in the breaker case display panel indicia indicating that the breaker is open or OFF. Then, upon articulation of the operating mechanism to charge the mechanism springs, the actuator element picks up the indicator arm, pivoting it to a new position where indicia on the display panel indicating the charged condition of the mechanism is registered with the window in the breaker case. When the latching means is operated to release the movable contacts, their movement into engagement with the stationary contact causes the indicator arm to be pivoted to still another position where the indicia ON borne by the display panel is registered in the case window. To open the circuit breaker, the operating mechanism is tripped, displacing the actuator element from the indicator arm. This, coupled with the opening movement of the breaker movable contacts and the bias of the return spring, returns indicator arm to its position where the display panel indicia OFF is again registered in the window.

The invention accordingly comprises the features of construction, combination of elements and arrangement of parts which will be exemplified in the construction hereinafter set forth, and the scope of the invention will be indicated in the claims.

For a fuller understanding of the nature and objects of the invention, reference should be had to the following detailed description taken in conjunction with the accompanying drawings, in which.

Like reference numerals refer to corresponding parts throughout the several views of the drawings.

DETAILED DESCRIPTION

Figure 1:
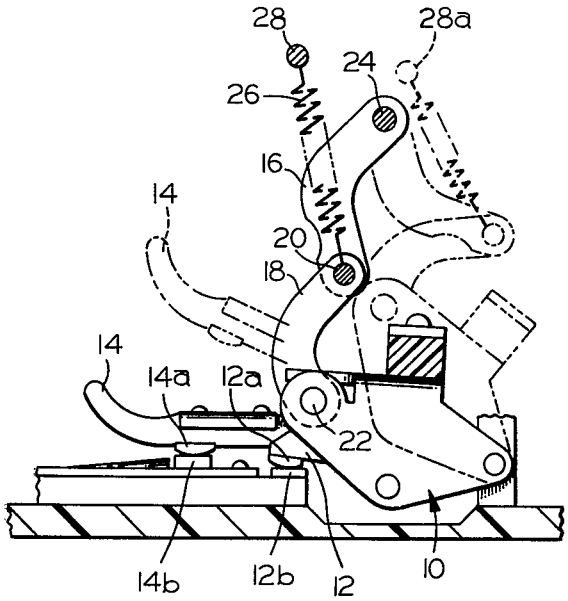
FIG. 1 is a simplified, fragmentary, side elevational view of a circuit breaker of the type to which the present invention is applicable.

The circuit breaker closure control condition indicator apparatus of the present invention is particularly, but not exclusively applicable to circuit breakers having toggle operating mechanisms of the type illustrated in FIG. 1. For a more detailed description of circuit breaker operating mechanisms of this character, reference may be had to commonly assigned U.S. Pat. No. 4,001,742. Thus, as seen in FIG. 1 herein, a pivotally mounted movable contact carrier for one breaker pole, generally indicated at 10, mounts a plurality of main movable contact arms, one seen at 12, and at least one movable arcing contact arm 14 for movement between a closed circuit position, seen in solid line, and an open circuit position, shown in phantom. The main contact arms 12 and arcing contact arm 14 carry movable contacts 12*a* and 14*a*, respectively, which engage their stationary contact counterparts 12*b* and 14*b* when the arms are in their closed circuit positions. A circuit breaker operating mechanism for translating the movable contact arms between their open and closed circuit positions includes a toggle consisting of an upper link 16 and a lower link 18 pivotally interconnected by a knee pin 20. The lower end of link 18 is pivotally connected to carrier 10 by a pin 22, while the upper end of upper link is pivotally connected to a post 24. Mechanism tension springs, indicated at 26, are connected between the toggle knee pin 20 and a pin 28 which is motivated by the breaker manual operating handle (not shown) from its phantom position 28*a* to its solid line position in the process of articulating the operating mechanism from its open circuit condition to its closed circuit condition.

It is seen that when pin 28 is in its phantom position 28*a*, the line of action of the mechanism springs 26 is to the right of pivot post 24 for the upper toggle link 16, causing the toggle to collapse to its illustrated phantom line position, resulting in upward pivotal movement of movable contact carrier 10 to its phantom line position. The movable contact arms ganged thereto are translated to their open circuit positions, also illustrated in phantom. To achieve contact closure, pin 28 is shifted leftward from its phantom position 28*a* to its solid line position. In the process, it is seen that the line of action of the mechanism springs 26 moves to the left of toggle pivot post 24. As a consequence, the mechanism springs can then act to straighten the toggle, causing the movable contact carrier 10 and the movable contact arms ganged thereto to pivot downwardly to their solid line, closed circuit positions.

Figure 2:
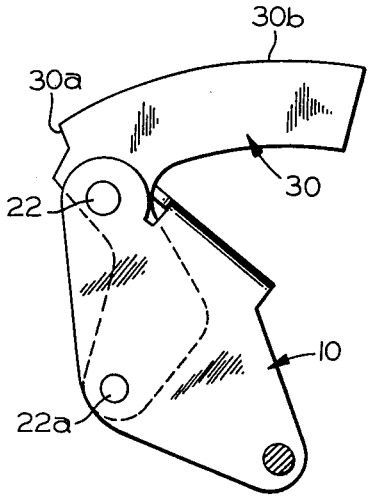
FIG. 2 is a simplified, side elevational view of a portion of the breaker movable contact carrier of FIG. 1, illustrating the adaption thereto of a latching member.
Figure 3:
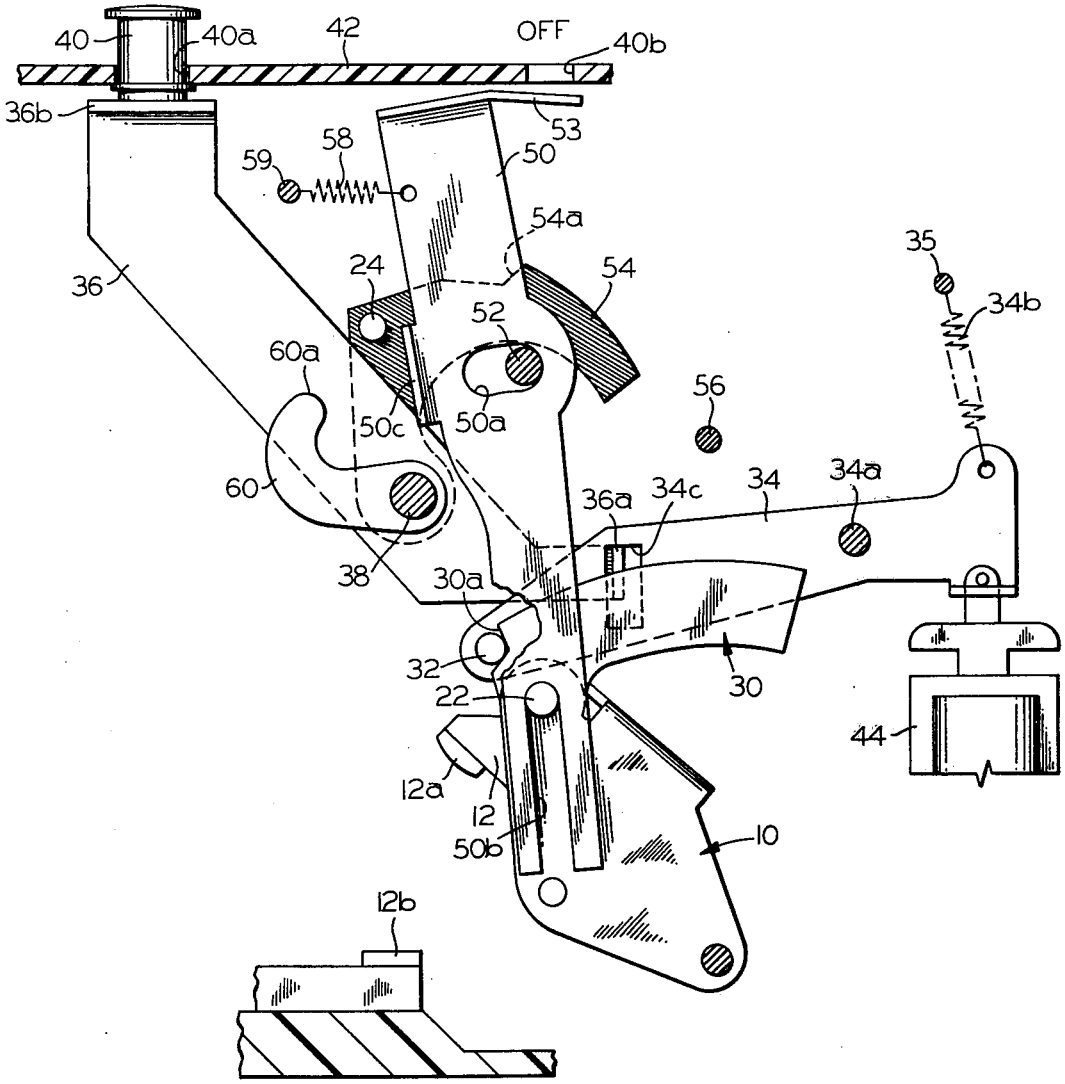
FIG. 3 is a side elevational view of the apparatus of the present invention, with its various parts illustrated in their positions assumed while the circuit breaker contacts are open and the breaker mechanism springs are discharged.

Turning to FIG. 3, the apparatus of the present invention is illustrated in its adaptation to a circuit breaker having an operating mechanism of the type generally illustrated in FIG. 1. To provide control over the closure of the breaker contacts, a latch member, generally indicated at 30, is affixed to movable contact carrier 10 by suitable means, such as pins 22 and 22*a*, as best seen in FIG. 2. This latch member is provided with a latch shoulder 30*a* which is engaged by a latch pin 32 carried at the left end of a latch lever 34 pivotally mounted on a pin 34*a* carried by the breaker frame (not shown). A tension spring 34*b* anchored at one end to a stationary post 35 and hooked at its other end to the right end of latch lever 34 biases the latch lever in the counterclockwise direction so as to maintain latch pin 32 in engagement with latch shoulder 30*a*. To defeat this latching engagement, a close lever 36 is pivotally mounted intermediate its ends on a pin 38 journaled at its ends by the operating mechanism frame (not shown). The lower end of close lever 36 is provided with a laterally turned tab 36*a* which is engaged in an opening 34*c* formed in latch lever 34. The upper end of close lever 36 is provided with a laterally turned flange 36*b* poised for engagement by a close button 40 mounted in an opening 40*a* provided in a cover 42 of the circuit breaker case. It is seen that when push button 40 is depressed, close lever 36 is pivoted in the counterclockwise direction about pin 38, causing its tab 36*a* to engage and lift latch lever 34 pursuant to disengaging latch pin 32 from latch shoulder 30*a*. If the mechanism springs 26 (FIG. 1) have been charged, it is seen that with the disengagement of latch pin 32 from latch shoulder 30*a*, the movable contact carrier 10 is free to pivot downwardly under the urgence of the mechanism springs to achieve breaker contact closure.

If desired, the apparatus of the present invention may be equipped with a closing solenoid 44 whose plunger is operatively coupled to the right end of latch lever 34. Upon energization of the solenoid, its plunger is retracted to pivot latch lever 34 in the clockwise direction, thereby disengaging latch pin 32 from latch shoulder 30*a* pursuant to effecting breaker contact closure.

To indicate the condition of the circuit breaker, the apparatus of the present invention provide an elongated indicator arm 50 which is jointly pivotally mounted by a pin 52, affixed to the mechanism frame and extending through a laterally elongated slot 50*a* in the indicator arm, and pin 22, affixed to carrier 10 and received in a longitudinally elongated, bottom opening notch 50*b* formed in the lower end portion of the indicator arm. The upper end of indicator arm 50 mounts a display panel 53 which bears various breaker condition indicia for individual registration with a window 40*b* in the breaker cover, depending upon the angular position of the indicator arm. Included with the breaker operating mechanism is a trigger or cradle 54 which is affixed on pin 38 journaled by the operating mechanism frame. The cradle is shown in FIG. 3 in its tripped position with its latch shoulder 54*a* in disengaged relation to a trip latch pin 56 operatively controlled by the circuit breaker trip mechanism (not shown). Cradle 54 also mounts post 24 which, as seen in FIG. 1, pivotally mounts the upper end of toggle link 16. Since in the situation depicted in FIG. 3 the breaker operating mechanism is in its tripped condition, the breaker movable contacts are in their open circuit position as illustrated. Under these circumstances, a return spring 58, anchored at one end at a stationary post 59 and hooked at its other end to the upper end of indicator arm 50, biases the indicator arm in the counterclockwise direction about pin 22 to an angular position determined by the abutment of pin 52 against the right end of slot 50*a* so as to register the indicia OFF borne by display panel 53 with window 40*b* in cover 42.

Figure 4:
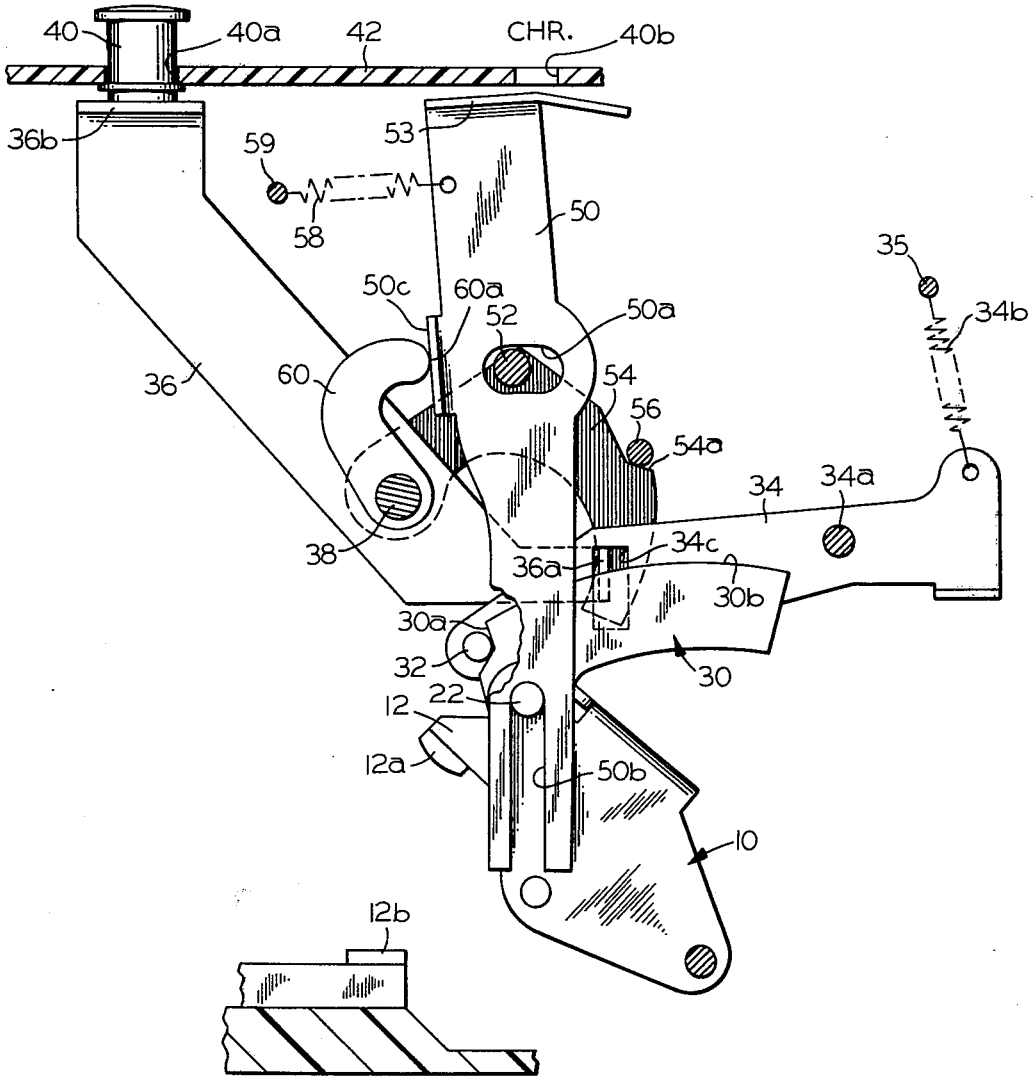
FIG. 4 is a side elevational view of the apparatus of FIG. 3, illustrating the position of its parts assumed when the breaker contacts are open and the mechanism springs are charged.

To reset the breaker operating mechanism and at the same time charge the mechanism springs, the operating mechanism is articulated by a suitable operating handle (not shown) in a manner to pivot cradle 54 about the axis of pin 38 in the clockwise direction around to the point where trip latch pin 56 can move into engaging relation with latch shoulder 54*a* of the cradle, as seen in FIG. 4. Affixed to post 38 and pivoting with cradle 54 during the resetting of the breaker operating mechanism is an actuating element 60. As the breaker operating mechanism is being reset, the nose 60*a* of this actuating element swings around in the clockwise direction into engagement with a laterally turned tab 50*c* carried by indicator arm 50. During the concluding increment of resetting motion of cradle 54, actuator 60 picks up and pivots indicator arm 50 about pin 22 in the clockwise direction to an intermediate angular position where the indicia CHR on display panel 53 is registered with window 40*b*. This indicia, when viewable through window 40*b* identifies to the operator that the breaker operating mechanism is reset and the mechanism springs are charged. It is noted that the lateral elongation of slot 50*a* permits this pivotal movement of the indicator arm about pin 22 from its OFF indicating position to its charged indicating position.

Continued articulation of the breaker operating mechanism then shifts pin 28 from its phantom line position 28*a* to its solid line position seen in FIG. 1, whereby the line of action of the mechanism springs 26 is oriented to straighten the toggle pursuant to effecting breaker contact closure. However latch lever pin 32 is engaging latch shoulder 30*a* of latch member 30 to inhibit contact closure despite the fact that the mechanism springs 26 are empowered to do so.

Figure 5:
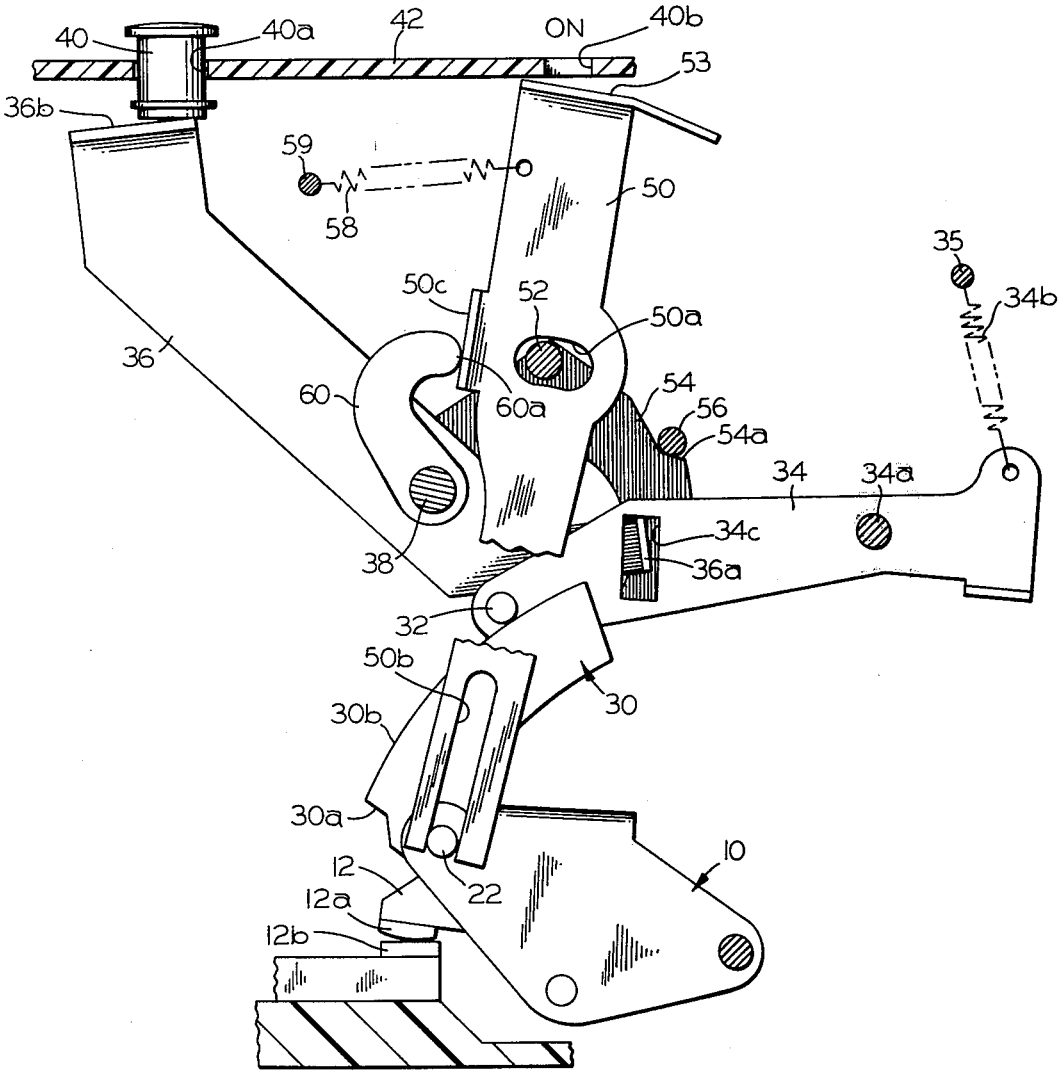
FIG. 5 is a side elevational view of the apparatus of the present invention, illustrating the positions of its various parts assumed when the breaker contacts are closed.

At the instant it is desired to effect closure of breaker contacts, latch lever 34 is articulated, either by depression of close push button 40 or energization of closing solenoid 44 (FIG. 3), to disengage latch pin 32 from shoulder 30*a* of latch member 30, whereupon the mechanism springs are freed to partially discharge pursuant to straightening the mechanism toggle and thereby precipitating breaker contact closure. From FIG. 5 it is seen that with the closure of the breaker contacts, pin 22 of the movable contact carrier 10 rides downwardly in notch 50*b*, thereby, in effect, camming the lower end of indicator arm 50 to the left from its position seen in FIG. 4. This effectively shifts the pivotal mounting of indicator arm 50 from a fulcrum created at pin 22 to pivot the engagement of nose 60*a* of actuator element 60 with indicator arm tab 50*c*. The resulting pivotal movement of indicator arm 50 in the clockwise direction brings it to a third angular position where the indicia ON borne by display panel 53 is registered with window 50*b* in the breaker cover 42.

So as to maintain control over the position of latch pin 32 at the end of latch lever 34, latching member 30 is provided with an elongated arcuate edge 30*b* against which the latch pin rides under the bias of return tension spring 34*b* all the while movable contact carrier 10 is away from its open circuit position. When the carrier returns to its open circuit position, latch pin 32 rides along the arcuate edge 30*b* until latch shoulder 30*a* arrives, whereupon it drops down into latching engagement with the shoulder under the bias of return spring 34*b*.

To open the breaker contacts, the breaker operating mechanism is tripped by moving trip latch pin 56 out of engaging relation with the cradle latch shoulder 54*a*. The cradle is thus freed to swing on its pivot post 38 in the counterclockwise direction as the mechanism springs discharge. This shifts the line of action of the mechanism springs to a position where they can collapse the toggle, thereby swinging movable contact carrier 10 upwardly to its open circuit position. It is seen that with cradle 54 swinging in the counterclockwise direction, actuating element 60 is also swung counterclockwise out of engagement with indicator arm 50. At the same time, the opening movement of contact carrier 10 coupled with the action of return spring 58 swings the indicator arm 50 around to its position shown in FIG. 3 where pin 52 is bottomed against the right end of laterally elongated slot 50*a*, thereby establishing the angular position of the indicator arm where the indicia OFF on display panel 54 is again registered with window 40*b* in cover 42.

It will thus be seen that the objects set forth above, among those made apparent in the preceding description, are efficiently attained and, since certain changes may be made in the above construction without departing from the scope of the invention, it is intended that all matter contained in the above description or shown in the accompanying drawings shall be interpreted as illustrative and not in a limiting sense.

Having described our invention, what we claim as new and desire to secure by Letters Patent is:

1. In a circuit breaker having a spring powered operating mechanism for translating movable contacts between open and closed circuit positions with respect to stationary contacts, apparatus for controlling the closure of the movable contacts and for indicating the various circuit breaker conditions, said apparatus comprising in combination:

A. latching means releaseably latching the movable contacts in their open circuit position against the force of charged mechanism springs acting to bias the movable contacts toward their closed circuit position;

B. release means selectively operable on said latch means to effect unlatching of the movable contacts, thereby enabling the charged mechanism springs to drive the movable contacts to their closed circuit position; and C. breaker condition indicating means including (1) an indicator arm mounted for movement between first, second and third positions, said arm being directly coupled with the movable contacts, (2) a display panel mounted by said arm, said panel bearing plural distinct breaker condition indicia for separate registry with a viewing window depending in the position of said arm, (3) a spring biasing said arm to its first position while the movable contacts are in their open circuit position and the operating mechanism springs are discharged, and (4) an actuator coupled with the breaker operating mechanism for movement from a discharged position to a charged position incident with articulation of the operating mechanism pursuant to the charging of the mechanism springs, in moving from said discharged to said charged positions, said actuator engaging and shifting said arm from its first to its second position, (5) upon unlatching of said latching means by said release means to precipitate translation of said movable contacts to their closed circuit position, said arm being controllably shifted from its second position to its third position by the closing movement of said movable contacts.

2. The apparatus defined in claim 1, wherein said indicator arm is mounted for pivotal movement between said first, second and third positions.

3. The apparatus defined in claim 2, wherein said indicator arm mounts said display panel at one end and is coupled to the movable contacts at its other end.

4. The apparatus defined in claim 3, wherein a transversely elongated first slot is formed in said indicator arm intermediate its ends, a stationary first post received through said first slot, and a longitudinally elongated slot is formed in said other end of said indicator arm, and a second post carried by the movable contacts is received through said second slot, whereby said indicator arm pivots on said second post when shifted from said first position to said second position by said actuator and pivots on a fulcrum located at the point of engagement of said actuator with said indicator arm when shifted from said second position to said third position by the translation of the movable contacts from their open circuit position to their closed circuit postion.

5. The apparatus defined in claim 4, wherein said first indicator arm position is determined by the engagement of said first post against one lateral end of said first slot.

6. The apparatus defined in claim 1, wherein said latch means includes a pivotal latch lever carrying a latch pin and latch member affixed to the movable contacts and having formed therein a latch shoulder releaseably engaged by said latch pin to latch the movable contacts in their open circuit position, said release means selectively operable to engage and pivot said latch lever so as to effect disengagement of said latch pin from said latch lever.

7. The apparatus defined in claim 6, wherein said latching means further includes a latching spring acting on said latch lever to bias said latch pin into engagement with said latch shoulder, said latch member further including an elongated control surface extending from said latch shoulder, said latch spring biasing said latch pin against said control surface while the movable contacts are removed from their open circuit position.

8. The apparatus defined in claim 7, wherein said indicator arm is pivotally mounted for movement between said first, second and third positions, and said indicator arm mounts said display panel at one of its ends and is coupled to the movable contacts adjacent its other end.

9. The apparatus defined in claim 8, wherein a transversely elongated first slot is formed in said indicator arm intermediate its ends, a stationary first post received through said first slot, and a longitudinally elongated slot is formed in said other end of said indicator arm, and a second post carried by the movable contacts is received through said second slot, whereby said indicator arm pivots on said second post when shifted from said first position to said second position by said actuator and pivots on a fulcrum located at the point of engagement of said actuator with said indicator arm when shifted from said second position to said third position by the translation of the movable contacts from their open circuit position to their closed circuit position.

10. The apparatus defined in claim 9, wherein said first indicator arm position is determined by the engagement of said first post against one lateral end of said first slot.

* * * * *